United States Patent [19]

Spork

[11] Patent Number: 4,914,881

[45] Date of Patent: Apr. 10, 1990

[54] ACCESS FLOORING SYSTEM

[75] Inventor: Leo Spork, Ascot, Australia

[73] Assignee: Techfloor Pty. Ltd., Indooroopilly, Australia

[21] Appl. No.: 242,193

[22] PCT Filed: Jan. 12, 1987

[86] PCT No.: PCT/AU87/00007

§ 371 Date: Sep. 7, 1988

§ 102(e) Date: Sep. 7, 1988

[87] PCT Pub. No.: WO87/04210

PCT Pub. Date: Jul. 16, 1987

[30] Foreign Application Priority Data

Jan. 10, 1986 [AU] Australia ..... PH4169
Mar. 17, 1986 [AU] Australia ..... PH5053

[51] Int. Cl.[4] ..... E04B 5/00
[52] U.S. Cl. ..... 52/263
[58] Field of Search ..... 52/126.6, 263; 403/43, 403/42

[56] References Cited

U.S. PATENT DOCUMENTS

| | | | |
|---|---|---|---|
| 719,790 | 2/1903 | Gregory | 404/43 |
| 2,867,301 | 1/1959 | Benton . | |
| 3,096,695 | 7/1963 | Reinhardt | 404/43 |
| 3,295,272 | 1/1967 | Kanno | 52/126.6 |
| 3,318,057 | 5/1967 | Norsworthy | 52/126 |
| 3,494,381 | 2/1970 | Fork | 52/221 |
| 3,903,667 | 9/1975 | Zetlin | 52/263 |
| 4,279,109 | 7/1981 | Madl, Jr. | 52/263 |
| 4,719,727 | 1/1988 | Cooper | 52/126.5 |

FOREIGN PATENT DOCUMENTS

| | | | |
|---|---|---|---|
| 369090 | 12/1982 | Australia . | |
| 142997 | 5/1985 | European Pat. Off. . | |
| 1915552 | 4/1970 | Fed. Rep. of Germany | 52/263 |
| 2043633 | 3/1971 | Fed. Rep. of Germany . | |
| 2107898 | 9/1971 | Fed. Rep. of Germany . | |
| 2328179 | 12/1974 | Fed. Rep. of Germany . | |
| 2314463 | 2/1975 | Fed. Rep. of Germany | 404/43 |
| 2348764 | 6/1975 | Fed. Rep. of Germany . | |
| 2900759 | 7/1980 | Fed. Rep. of Germany . | |
| 1236484 | 6/1971 | United Kingdom . | |

*Primary Examiner*—John E. Murtagh
*Attorney, Agent, or Firm*—Kimmel, Crowell & Weaver

[57] ABSTRACT

A modular access flooring system (10) has triangular floor panels (11) supported at the corners by free-standing pedestals (12) which are laid on a base floor. Hemispherical projections (18) on the panels (11) engage in recesses (19) in the pedestals (12) to lock the panels (11) and pedestals (12) together during installation of the system (10), the panels (11) and pedestals (12) determine where the others are to be positioned, obviating the requirement for the pedestals (12) being laid in predetermined patterns. As the panels (11) and pedestals (12) are all supported at three points, the flooring system (10) is very stable and can accommodate any movement in the base floor.

11 Claims, 4 Drawing Sheets

FIG.3
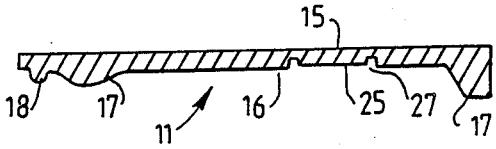
FIG.4
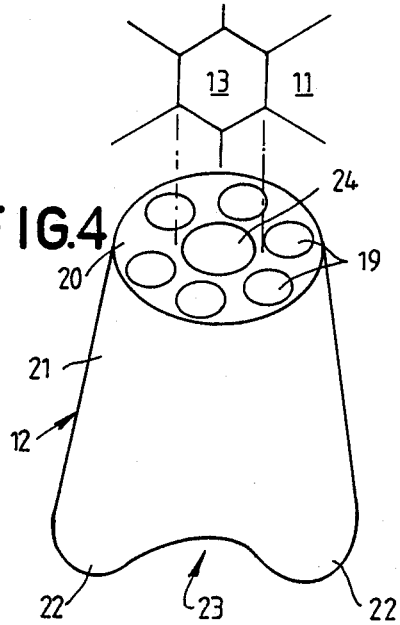
FIG.5
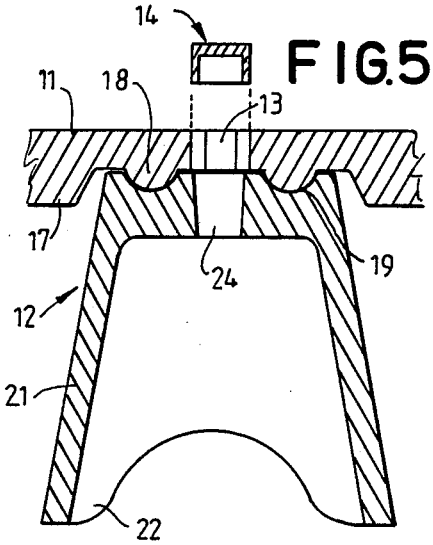
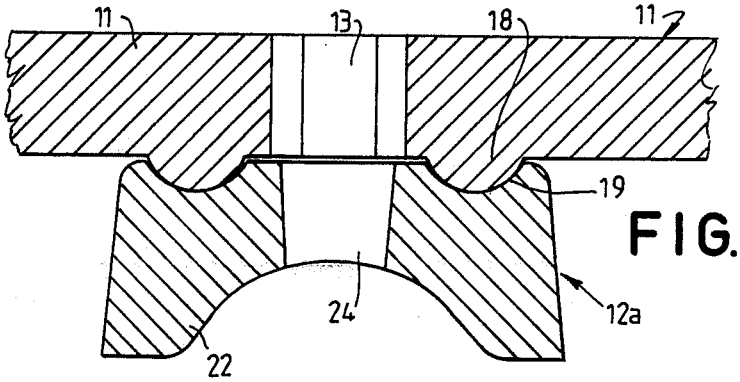
FIG.6

ACCESS FLOORING SYSTEM

BACKGROUND OF THE INVENTION (1) Field of the Invention

THIS INVENTION relates to a modular access flooring system which may be laid over a load-bearing base floor in a building to create a space in which wires, cables and pipes may be laid.

(2) Prior Art

Many types of access flooring systems have been developed to accommodate the electrical wiring and other utility services found in modern office environments. Examples of these are disclosed in GB No. 1236484, DE No. 2043633 and DE No. 2107898 (all by Central Flooring Ltd.) DE No. 2328179 (Staeger); DE No. 2348764 (Goldbach GmbH); DE No. 2900759 (Marbeton); EP No. 0142997 (Taisei Corporation); AT No. 369090 (Voest-Alpine); U.S. Pat. No. 2867301 (Benton); U.S. Pat. No. 3318057 (Norsworthy) and U.S. No. 4279109 (Madl).

None of these systems have proved satisfactory. Installation is slow and laborious as the pedestals must be fixed to the base floor in carefully spaced arrangements to ensure the correct relationship of the floor panels and the pedestals must be adjusted in height to accommodate any variations in the base floor. The panels are prone to rock or tilt as loads move over them and the pedestals must be realigned if the base floor should settle or move. The steel components in the pedestals and grid frames can cause electrical interference in the electrical wires and cables.

Other specific problems arise in each of the known systems.

SUMMARY OF THE PRESENT INVENTION

It is an object of the present invention to provide an access flooring system which is simple and quick to install and which comprises the minimum number of components.

It is a preferred object to provide a system where the pedestals are free-standing on the base floor and where the pedestals and panels are stable i.e. they are rock-rattle proof.

It is a further preferred object to provide a system where the pedestals and panels are interlocked by means which accurately position the components as the system is installed and which maintain the system automatically and continuously aligned with the base floor.

It is a still further preferred object to provide a system where the components are formed of glass-reinforced concrete so they will not corrode, rust or deteriorate and the system has a good fire rating and excellent acoustic properties.

Other preferred objects of the present invention will become apparent from the following description.

In a broad aspect the present invention resides in an access flooring system including:

a plurality of spaced, free-standing support pedestals arranged to stand on a base floor; and a plurality of substantially planar floor panels removably supportable on the pedestals, each panel having a top surface and a bottom surface; wherein:

each floor panel has a plurality of interlocking means on its bottom surface engageable with respective complementary interlocking means on the pedestals to locate the floor panel in respect to adjacent floor panels; and each pedestal has a plurality of feet engageable with the base floor.

The interlocking means on the panels may comprise moulded projections, or recesses, on the bottom faces of panels which are engageable with complementary moulded recesses, or projections respectively, as the top surfaces of the pedestals.

Preferably the projections and recesses are of complementary hemispherical configuration to provide a ball and socket type connection between the panels and the pedestals.

Preferably the panels are substantially triangular in plan view with the projections or recesses adjacent the corners. The corners of the panels may be rebated so that at the junction of six of the panels, a hexagonal interstilial hole is provided between the panels which may be filled with a hexagonal infill member or cap.

Preferably the panels are moulded from glass-reinforced concrete, glass-reinforced plastic or other suitable material. The panels may have a peripheral rim around the bottom face and be provided with one or more "knock-out" pieces defined by grooves formed in the bottom face.

Preferably the pedestals are of inverted frusto-conical configuration with a substantially planar top face in which is moulded six recesses or projections. Preferably a central hole in the top face provides communication to the interior of the hollow body.

Preferably three feet or projections are provided around the base of the pedestal to be stably supported on the base floor in a free-standing manner. The pedestals may be made in varying heights or may be nestable together. If necessary packing strips may be placed under the feet. Preferably the pedestals are constructed of the same material on the panels.

BRIEF DESCRIPTION OF THE DRAWINGS

To enable the invention to be fully understood, a number of preferred embodiments will now be described with reference to the accompanying drawings, in which:

FIG. 3 is a sectional side view of a floor panel taken on line 3—3 on FIG. 2;

FIG. 4 is a top view of a pedestal;

FIG. 5 is a sectional side view showing the interlocking between the panels and a pedestal;

FIG. 6 is a view similar to FIG. 5 using a modified pedestal;

DETAILED DESCRIPTION OF THE PREFERRED EMBODIMENTS

Figure 1:
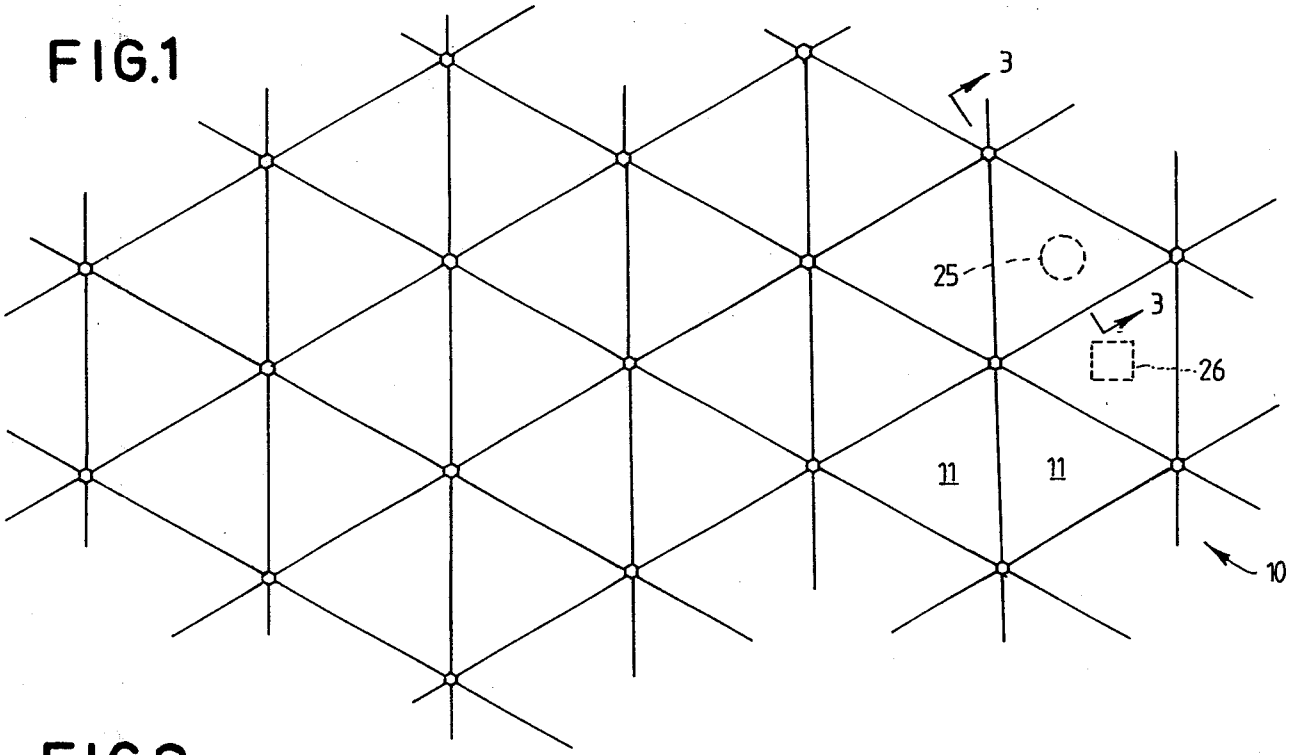
FIG. 1 is a plan view of a portion of the flooring system.
Figure 2:
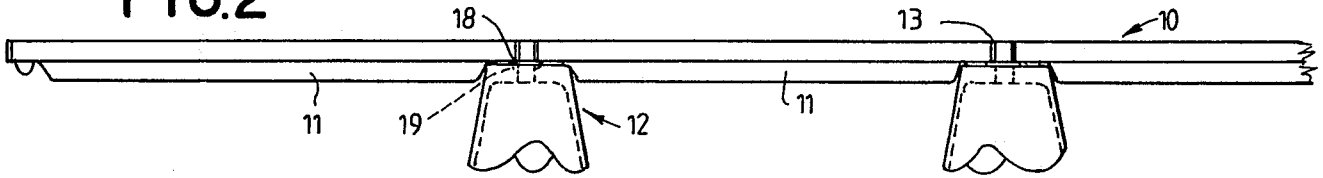
FIG. 2 is a side elevation of the flooring system.

Referring to FIGS. 1 to 5, the access flooring system 10 comprises a plurality of floor panels 11, triangular in plan, supported on free-standing pedestals 12 on a base floor (not shown). The panels 11 and pedestals 12 are moulded of glass-reinforced concrete and have a high fire rating, will not rust or corrode, and have excellent acoustic properties.

As shown in FIG. 4, the corners of the panels 11 are rebated so that a hexagonal interstitial hole 13 is formed above each pedestal, these holes being selectively filled by hexagonal plastic caps 14 (see FIG. 5).

Each panel 11 is substantially planar with a planar top surface 15 and planar bottom surface 16 surrounded by a peripheral rim 17. Adjacent each corner, the panel is relieved and is provided with a hemispherical projection 18.

The projections 18 on the panels are arranged to engage in respective hemispherical recesses 19 in the top surface 20 of the pedestals. Each pedestal has hollow, frusto-conical body 21 supported on three feet 22. Because of the tripod-like base, the pedestals are stably supported on the base floor. The recesses 23 between the feet allow wires or cables to be passed down through the interstitial hole 13, and hole 24 in the top surface, and laid along the base floor.

As previously stated, as each panel 11 is supported at three points, and each pedestal 12 stands on three feet 22, the floor assembly 10 is totally stable and will not rock or rattle as a load moves over the floor. Should the floor move or settle, the movement will be accommodated by the "ball and socket" type connection between the projection 18 on the panels and the recesses 19 on the pedestals.

The floor system 10 is very simply and quickly installed. From a selected starting point, one pedestal 12 is positioned and a panel 11 is supported at one corner on it. The panel 11 determines where the next two pedestals 12 are placed to support it. These pedestals now determine where the next panels are to be laid and so the floor system is progressively laid with the panels and pedestals automatically locating each other.

If the base floor is uneven, the floor system will follow the contour of the base floor. However, if required, packing strips or discs may be placed under one or more feet 22 of the pedestals 12 to horizontally align the pedestals (and floor panels). Subsequent to its installation the system will automatically follow floor contour changes or movements.

If required, knock-out sections 25, 26 may be cast into the panels 11, defined by peripheral grooves 27 formed in the bottom face 16 of the panels. As the pedestals 12 are tapered, they can be nested together to increase the height of the space between the panels and the base floor. Alternatively, where only a shallow height is required, modified pedestals **12*a*, again having three feet 22**, may be used.

Because the flooring system must be capable of being laid in buildings not designed for it, or over irregular floor plans, two alternative peripheral systems can be used.

Figure 7:
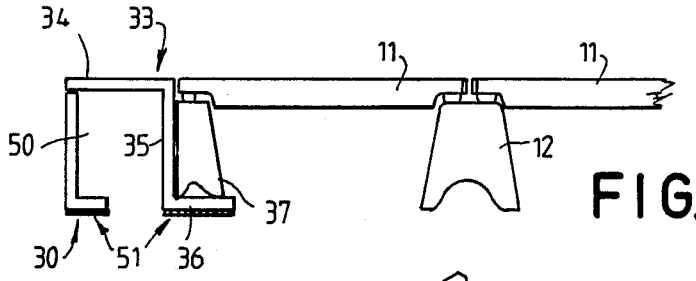
FIG. 7 is an end elevational view of one peripheral system for the floor.
Figure 8:
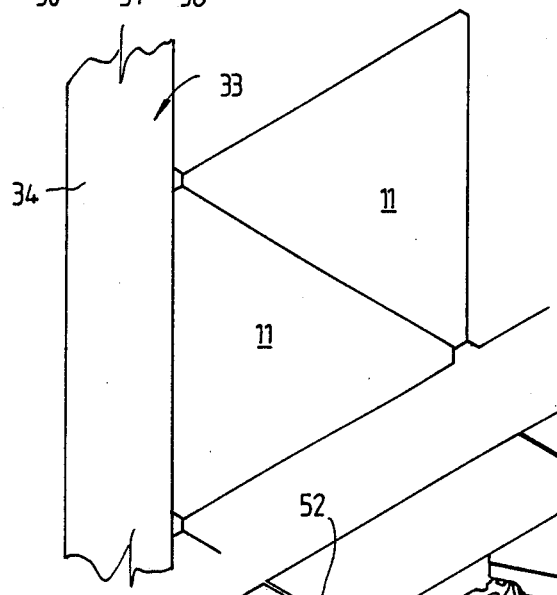
FIG. 8 is a plan view of the periphery system.
Figure 9:
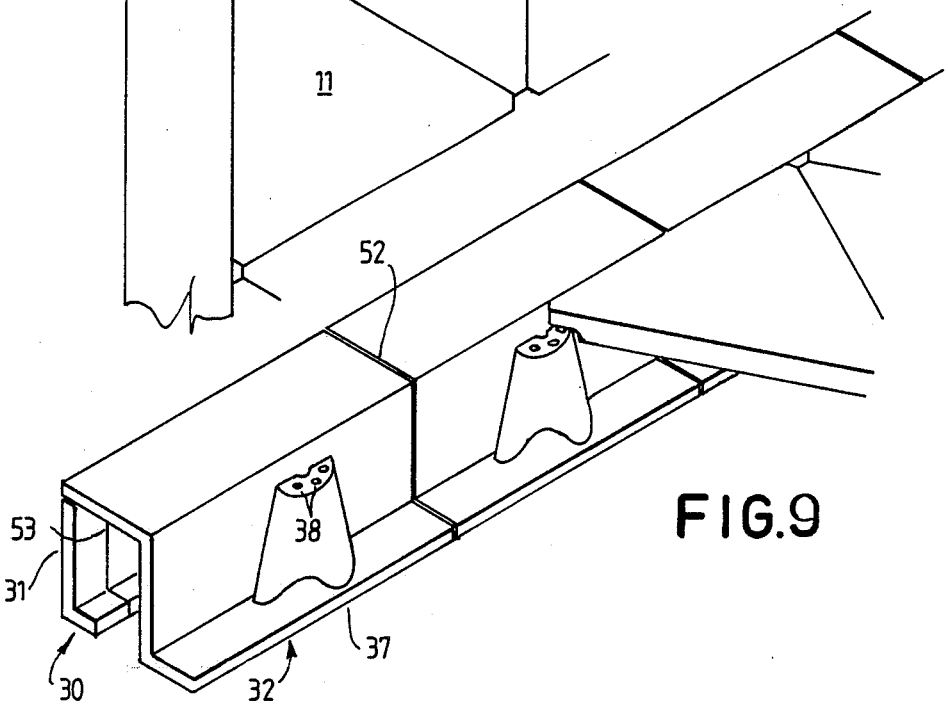
FIG. 9 is an isometric view of the periphery system.

Referring to FIGS. 7 to 9, a series of support legs 30 are fixed to the building wall 31 and floor 32 by grout 51 or other suitable fixing means. A perimeter edging strip 33, with a top flange 34, leg 35 and foot 36, is trimmed to width and is positioned along the walls 31. The foot 36 is grouted to the floor 32 and the outer side of the top flange 34 is supported by the support legs 30. The grouted edging strip 33 may provide a complete air seal to a sealed plenum beneath the flooring for air conditioning purposes.

To support the outer row of panels 11, half-pedestals 37 (which have three feet) are seated on the leg of the edging strip at the required spacings to enable the projections 18 on the panels to engage the recesses 38 in the half-pedestals 37. (In a modified embodiment not shown, the half-pedestals 37 may be moulded integrally with the edging strip 33 at the required spacings.)

Space 50 (FIG. 7) constitutes a volume that will hold and contain water in the event of automatic sprinklers coming on. The space 50 will be filled through joints 52, and where some flow over the edge occurs through joint 53 (FIG. 9).

Both the support legs 30 and the edging strip 33 are moulded of glass-reinforced cement.

Figure 11:
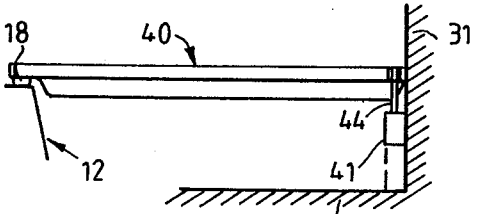
FIG. 11 is an end elevational view of the pheriphery system.
Figure 12:
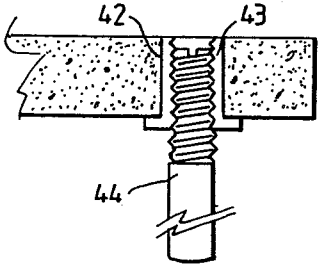
FIG. 12 is a sectional end view of a portion of the periphery system in more detail.

In a second peripheral system, which is particularly suitable where the floor plan is irregular e.g. the building wall 31 is curved, rhomboid shaped panels 40 are used. Each panel 40 is moulded of glass-reinforced concrete and is of similar cross-section to the floor panels 11 (see FIG. 11). However, a projection 18 is provided at each of the four corners and arranged to engage the recesses in the pedestals 12. When the floor panels 11 have been laid as close as possible to the wall 31, the rhomboid panels 40 are cut to shape to fill the remaining spaces.

A ledge or step 41 is laid around the wall and is fixed to the wall 31 and the floor 32. Holes 42 are drilled into the panels 40 adjacent the periphery and are fitted with screw-threaded plastic ferrules 43. Screw-threaded legs 44 are engaged in the ferrules 43 and they are supported on the step 41. By rotating the legs 44, the panels 40 can be levelled with the adjacent panels 11.

Figure 10:
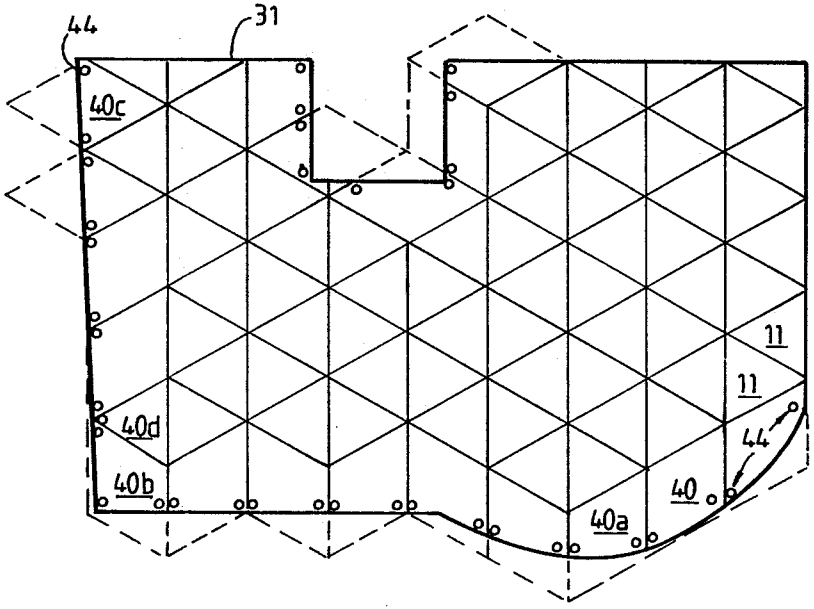
FIG. 10 is a plan view of a second pheriphery system.

Referring to FIG. 10, it will be noted that panel **40*a* is supported on two pedestals 12 and two legs 44, while panel 40*b* is supported on one pedestal and tnree legs, panel 40*c* on one pedestal and two legs and panel 40*d*** is supported on two pedestals and one leg.

If underfloor access is ever required, the panels 11, 40 can be raised using suction cups or handles as are currently used for existing flooring systems. The practical advantages of the access flooring system of the present invention include:

1. the triangular (i.e. three point) seating of the panels and pedestals ensures a stable floor which will not rock or rattle;

2. the interlocking of the panels and pedestals enables the floor to be installed quickly and simply without requiring preplacement of the pedestals;

3. the system is automatically and continuously aligned with the base floor;

4. the system is stable in all directions and does not rely on the surrounding building walls for lateral stability (i.e. the free standing floor is laterally stable);

5. the interlocking balls and recesses allow the panels and pedestals to move and adjust so the system can follow the contour of the base floor in case of floor movement;

6. because the components are moulded of glass-reinforced concrete, they will not rust or corrode (even if the system is used as part of an air conditioning plenum), they will not cause electrical interference, they have a top fire rating and excellent acoustic properties, and they are not affected by hydrothermal changes; or 7. the system can be readily used with irregular floor plans.

Other advantages of the system will be readily apparent to the skilled addressee.

Various changes and modifications may be made to the embodiments described without departing from the scope of the present invention defined in the appended claims.

I claim:

1. An access flooring system including a plurality of free-standing support pedestals spaced apart over a base floor, and a plurality of floor panels removably supported on said pedestals, wherein:

each said panel has a substantially triangular shape in plan view, with a substantially planar top surface and a bottom surface;

said pedestals each have three spaced apart supporting legs for providing stable free-standing support for said pedestals on said base floor; and complementary interlocking means on the top of said pedestals and on the underside of said panels at the corners thereof for locating said panels on said pedestals, said interlocking means comprising generally hemispherically shaped projections and recesses on the panels and pedestals, respectively, providing ball and socket type connections between the panels and the pedestals, whereby the panels and pedestals are self-aligning.

2. An access flooring system as claimed in claim 1, wherein:

said pedestals have a top surface and said interlocking means of said pedestals are formed on said top surface.

3. An access flooring system as claimed in claim 1, wherein:

the corners of said panels are truncated so as to define a central recess at the junction of a plurality of panels supported on a pedestal; and an infill member shaped complementary to said recess and adapted to be releasably received therein.

4. An access flooring system as claimed in claim 1, wherein:

said panels are molded of glass-reinforced concrete.

5. An access flooring system as claimed in claim 2, wherein:

said pedestals are of inverted frustoconical configuration, and the bases thereof are recessed at spaced apart positions so as to define therebetween said supporting legs.

6. An access flooring system as claimed in claim 2, wherein:

a central hole is formed in said top surface of said pedestals for passage of wires or cables therethrough.

7. An access flooring system as claimed in claim 1, wherein:

said pedestals are molded of glass-reinforced concrete.

8. An access flooring system as claimed in claim 1, wherein:

a peripheral infill system is provided around the periphery of said flooring system to fill the space between a building wall and the panels of said flooring system, said peripheral infill system including an edging strip arranged on said base floor adjacent said wall and a plurality of half pedestals seated on said edging strip to support adjacent panels.

9. An access flooring system as claimed in claim 1, wherein:

a peripheral infill system is provided to fill the space between a building wall and the panels of said flooring system, said peripheral infill system including a plurality of rhomboid-shaped panels having one of a projection or recess at each corner engageable with the complementary projection or recess of said pedestals; and said rhomboid-shaped panels being arranged to be cut to shape to fill the spaces between the building wall and the panels and supported on one or more of said panels and on one or more height-adjustable legs screw-threadably received in ferrules positoined in the outer corners of the rhomboid panels adjacent said building wall.

10. An access flooring system comprising a plurality of free-standing support pedestals spaced apart over a base floor, and a plurality of floor panels removably supported on said pedestals, wherein:

each panel has a substantially triangular shape in plan view and has a substantially planar top surface and a bottom surface;

a plurality of interlocking means on said panels engaged with complementary interlocking means on the pedestals for locating the panels on the pedestals and for positioning the panels relative to adjacent panels;

said panels and pedestals being molded of reinforced concrete;

said interconnecting means on the panels and pedestals comprise integrally molded projections and recesses of generally hemispherical configuration defining ball and socket type connections between the panels and pedestals; and said pedestals include three support legs defining a tripod-like support for said pedestals.

11. An access flooring system comprising a plurality of free-standing, spaced apart support pedestals arranged on a supporting base, and a plurality of floor panels removably supported on the pedestals, wherein:

each panel has a substantially triangular shape in plan view and has a substantially planar top surface and a bottom surface;

said pedestals have a top surface, and said panels are supported at or adjacent their corners on said top surfaces of said pedestals;

a plurality of complementary interlocking projection and recess means of ball and socket form on the top surface of the pedestals arranged at spaced apart positions therearound and on the bottom surface of the panels at the corners thereof for locating the panels relative to the pedestals and to one another, whereby a pedestal may support a plurality of said panels arranged in edge-to-edge relationship about said pedestal, respective panels engaging and being supported by respective interlocking means on said pedestal; and said pedestals are supported by three spaced apart legs defining a tripod-like support for said pedestals.

* * * * *